US012103812B2

(12) United States Patent
Wang et al.

(10) Patent No.: US 12,103,812 B2
(45) Date of Patent: Oct. 1, 2024

(54) FLEXIBLE LAYER SUPPORT STRUCTURE AND RETRACTABLE DEVICE

(71) Applicants: Qingdao University of Technology, Qingdao (CN); Ziguo Wang, Qingdao (CN)

(72) Inventors: Ziguo Wang, Qingdao (CN); Yuyan Sun, Qingdao (CN)

(73) Assignees: Qingdao University of Technology, Qingdao (CN); Ziguo Wang, Qingdao (CN)

( * ) Notice: Subject to any disclaimer, the term of this patent is extended or adjusted under 35 U.S.C. 154(b) by 0 days.

(21) Appl. No.: 18/534,405

(22) Filed: Dec. 8, 2023

(65) Prior Publication Data

US 2024/0109750 A1 Apr. 4, 2024

Related U.S. Application Data

(63) Continuation of application No. PCT/CN2022/096634, filed on Jun. 1, 2022.

(30) Foreign Application Priority Data

Jun. 10, 2021 (CN) ..... 202110649443.3

(51) Int. Cl.
*B65H 75/44* (2006.01)

(52) U.S. Cl.
CPC ..... *B65H 75/4465* (2013.01); *B65H 75/4471* (2013.01); *B65H 2701/1133* (2013.01)

(58) Field of Classification Search
CPC ..... B65H 75/44; B65H 75/4465; B65H 75/4471; B64G 1/222
See application file for complete search history.

(56) References Cited

U.S. PATENT DOCUMENTS 8,009,421 B2 * 8/2011 Misawa ..... G02F 1/133308 345/157
2020/0410908 A1 12/2020 Chu et al.
(Continued)

FOREIGN PATENT DOCUMENTS

| | | |
|---|---|---|
| CN | 103712052 A | 4/2014 |
| CN | 209401248 U | 9/2019 |
| CN | 210627729 U | 5/2020 |

OTHER PUBLICATIONS

Internation Search Report of PCT/CN2022/096634, Mailed Aug. 17, 2022.

*Primary Examiner* — Sang K Kim

(57) ABSTRACT

A flexible layer support structure and a retractable device is disclosed. The flexible layer support structure includes a first thin sheet and a second thin sheet arranged in parallel with each other, as well as and a folding spring group sandwiched between the first thin sheet and the second thin sheet and arranged in parallel. The curved elastic pieces in the folding spring group are smoothly overlapped and connected with the thin sheets, so as to enclose a hollow thin-walled elastic structure that can be overlapped and rolled up, can be automatically straightened and has a flat surface. The retractable device includes a winding shaft, a pressure roller, and a flexible layer support structure installed on the winding shaft. The flexible layer support structure of the present disclosure has the advantages in lightweight, high storage ratio, large unfolded area, simple winding, large load bearing capacity, and less damage.

7 Claims, 12 Drawing Sheets

(56) References Cited

U.S. PATENT DOCUMENTS

| | | | | |
|---|---|---|---|---|
| 2021/0083210 | A1 | 3/2021 | Wang et al. | |
| 2021/0387750 | A1* | 12/2021 | Fernandez | B64G 1/222 |
| 2022/0098861 | A1* | 3/2022 | Fernandez | E04C 3/005 |
| 2023/0373659 | A1* | 11/2023 | Rakow | B64G 1/222 |

* cited by examiner

FLEXIBLE LAYER SUPPORT STRUCTURE AND RETRACTABLE DEVICE

CROSS-REFERENCE TO RELATED APPLICATIONS

This application is a continuation of International Application No. PCT/CN2022/096634 with a filling date of Jun. 1, 2022, designating the United states, and further claims to the benefit of priority from Chinese Application No. 202110649443.3 with a filing date of Jun. 10, 2021. The content of the aforementioned applications, including any intervening amendments thereto, are incorporated herein by reference.

TECHNICAL FIELD

The present disclosure relates to a flexible layer support structure and a retractable device, which are used for stable support of various flexible planes after unwinding.

BACKGROUND

To make a flexible screen can roll up and unwind on a sufficiently small radius winding shaft without creases or plastic deformation, the flexible screen must be soft and thin enough. The existing flexible screen technology has already very advanced that screens can be as thin as 0.01 mm with the minimum curling radius of 1 mm, soft enough to float with the wind. But such a lightweight screen needs to be equipped with a certain stiffness, expandable and retractable support framework to maintain a stable shape for easy touch operation and watching. At present, the support framework of flexible screen mainly uses devices such as guide rail type pull-out sliding rods, folding rods, and hinges as the frameworks. However, those framework structure are in complex structures with limited screen expansion, and the occupied space and self weight are relatively large. Moreover, the framework and screen are generally arranged in a separate manner, which cannot provide full protection and support for the screen. The scroll screen display device, which can be unwound like a scroll, is still in the conceptual design stage. There is an urgent need for an advanced support structure that is lightweight and highly stiffness, able to protect the entire surface, automatically flattened after unwinding, and can be rolled up and unwound freely.

The Chinese patent application with application number 201310752951. X discloses a flexible thin-walled support structure for supporting the unfolded flexible screen. The patent application solution combines the first elastic convex thin-walled component and the second elastic convex thin-walled component to form a thin-walled structure with a large bending moment of inertia and torsional moment of inertia. The elastic resilience of the first elastic convex thin-walled component and the second elastic convex thin-walled component bears a large bending moment and axial pressure, maintaining the stability of the rollable flexible screen loaded on the support structure after unwinding. At the same time, the first elastic convex thin-walled component and the second elastic convex thin-walled component can be elastically overlapped for winding.

The thin-walled support structure of the above solution can achieve the unwinding and rolling up of flexible planes, but there are the following problems: (1) The two outer surfaces of the thin-walled structure are both convex arc surfaces, which is not conducive to reliable fixation with the mounted flexible plane;

(2) In the unfolding state of flexible plane, the two outer surfaces of a thin-walled structure formed under the elastic action of the first elastic convex thin-walled component and the second elastic convex thin-walled component both are outwardly protruding arc surfaces. Due to the outward arch of the center between the first elastic convex thin-walled component and the second elastic convex thin-walled component, the transverse joint parts on both sides of the thin-walled structure move towards each other, the transverse size of the thin-walled structure in this state should be smaller than the transverse size of the first elastic convex thin-walled component and the second elastic convex thin-walled component after flattening. In the state of winding the flexible screen together with the thin-walled structure, the first elastic convex thin-walled component and the second elastic convex thin-walled component are overlapped and flattened, and the transverse joint of the thin-walled structure moves outward. The transverse size of the thin-walled structure unfolds in the transverse direction equal to the transverse size flattened by the first elastic convex thin-walled component and the second elastic convex thin-walled component. It can be seen that the transverse size of the thin-walled support structure will change when it is unwound and rolled up. When multiple sets of thin-walled support structures are mounted on the same flexible plane, the rolling up and unwinding operation will cause tension at the joint positions of different thin-walled support structures and flexible planes, affecting the fixation of the flexible plane on the thin-walled support structure.

(3) The interlayer shear forces of the overlapped bending of the first elastic convex thin-walled component and the second elastic convex thin-walled component can only be transmitted laterally inside the surfaces of the two thin-walled components, and counteract each other at the joint part of the two components. Due to the thinner thin-walled components in the structure, when the structure is bent, the closer to the joint part, the greater the shear stress, and the distribution of the shear stress is uneven, resulting in inconsistent local deformation and accumulation of longitudinal deformation. Therefore, under this condition that is away from the shear force transmission path, it is easy to yield or deform too much and cause out of plane instability, making it difficult to make the overlapped structure fit the winding shaft for rolling up. Especially when the width of the structure is large and the curling radius is small, the interlayer shear force of the structure will be greater, making it more prone to out of plane deformation or instability, such that the elastic components of each layer cannot be tightly overlapped and folded, and even if bent within the elastic range, they cannot be uniformly wound on the winding shaft, which can easily cause uneven deformation of the flexible equipment, leading to damage.

SUMMARY

The present disclosure is to provide a stable and reliable flexible layer support structure and a retractable device to solve the above-mentioned problems of the rollable thin-walled support structure.

The present disclosure adopts the following technical solution for implementation:

A flexible layer support structure, including at least two thin sheets overlapped with each other and at least two folding springs sandwiched between the thin sheets in parallel; the folding springs are arranged parallel to each other along a first direction of the thin sheets, and each of the folding springs is a long waveform compression spring formed by even number of curved elastic pieces in series connection extending along a second direction of the thin sheets; the folding springs have an elastic trend of prop opening the thin sheets on two sides, and all of the curved elastic pieces are overlapped with the thin sheets to form a layer structure after being compressed; outer edges of the curved elastic pieces at two outer ends of the folding springs are smoothly lapped with adjacent thin sheets, and a hollow thin-walled layer structure with bending stiffness is formed between the folding springs and the thin sheets; when the thin sheets are subjected to sufficient overlapping pressure in a deformation direction of the folding springs, all the thin sheets and the folding springs of the flexible layer support structure are overlapped into a flexible layer structure that is capable to be bent or rolled up; and the folding springs quickly and elastically prop open the thin sheets to restore an original state after the overlapping pressure is removed.

Further, the thin sheets include a first thin sheet and a second thin sheet; all of the folding springs are distributed within a projection area where the first thin sheet and the second thin sheet overlapped with each other; connection positions between the curved elastic pieces and the first thin sheet and the second thin sheet are fixed joint parts, connection positions between the curved elastic pieces within the projection area of the first thin sheet and the second thin sheet are free joint parts, and the free joint parts translate along the first direction of the thin sheets during folding and unfolding process of the folding springs, the free joint parts of adjacent folding springs are arranged in face-to-face direction or opposite direction, and a gap is set between the free joint parts arranged in the face-to-face direction for the free joint parts to translate.

Further, the sum of the width of all of the curved elastic pieces on the same layer after flattened unfolding and a gap width of joint parts is not greater than a width of the thin sheet connected to them, and the gap width is not less than a sum of a maximum stroke of translations of the free joint parts on the two sides. Moreover, as long as the sum of the flattened width of all curved elastic pieces on the same layer and the gap width at the joint parts is equal to the width of the connected thin sheet, even if there is an inconsistency in the width of the first sheet and the second thin sheet, or if there is an inconsistency in the initial thickness of the folding springs, resulting in a small angle between the two thin sheets that is not completely parallel, or if there is an inconsistency in the flattened width of two curved elastic pieces in the folding spring, or two curved elastic pieces are not symmetrical along the overlapping surface in the natural state, the flexible layer support structure can still achieve overlapping and flattening. But try to arrange the thin sheets, folding springs, and curved elastic pieces in the structure symmetrically, which can be considered as the optimal option.

Further, the cross section of the curved elastic pieces along the first direction is a smooth curve, and smooth transition to tangential connections form between ends at the two sides and the fixed joint part or the free joint part, forming folding springs with at least one V-shaped opening.

Further, the first thin sheet and the second thin sheet are fixedly connected with side sealed folding springs along two lateral sides of the second direction; the side sealed folding springs on a same side of the first thin sheet and the second thin sheet extend outward and are fixedly connected to seal edges of the two sides between the first thin sheet and the second thin sheet.

Further, the thin sheets, the folding springs, and side sealed folding springs are made of one or more materials selected from the group consisting of metal material, polymer material, fiber reinforced polymer, metal wire frameworks, or porous thin sheets.

Further, the fixed bonding method of the fixed joint parts and the free joint parts includes bonding, welding, fusion, crimping or riveting.

Further, the curvature of the cross-section of the curved elastic pieces and any point after bending or winding of the thin sheets satisfies the following relationship:

$$\frac{1}{\rho} \leq \frac{2\sigma_e}{tE};$$

Wherein: t is a thickness of the curved elastic pieces or the thin sheets;

E is an elastic modulus of the curved elastic pieces or the thin sheets;

$\rho$ is a curvature radius of a neutral layer of a single curved elastic piece or a single thin sheet;

$\sigma_e$ is an elastic limit value of the curved elastic pieces or the thin sheets.

Further, two or more sets of folding spring groups connected in series are sandwiched between the first thin sheet and the second thin sheet, and an intermediate layer is provided between the folding springs.

In the preferred solution of the flexible layer support structure of the present disclosure, at least two sets of the thin sheets are assembled along the first direction, and assembly sides of the thin sheets are provided with lap step structures embedded with each other.

Further, the thickness of the thin sheets and the curved elastic pieces is 0.001-2 mm, preferably 0.01-0.5 mm.

Further, surfaces of the curved elastic pieces of the folding springs, the first thin sheet, and the second thin sheet are provided with concave-convex structures that engage with each other under a folded and overlapped state of the flexible layer support structure.

Further, the concave-convex structures include concave-convex stripe structures arranged along the first direction or the second direction, concave-convex embossed structures distributed on the surface, or a plurality of shear keys and keyways/holes.

Further, a retractable device is provided by the present disclosure, which includes a winding shaft, a pressure roller, and a flexible layer installed on the winding shaft, wherein the flexible layer is used the flexible layer support structure mentioned above; there is a gap between the pressure roller and the winding shaft, or between the pressure rollers, with a width less than the thickness of the flexible layer in unfold state; the flexible layer passes through the gap and is wound and installed on the winding shaft; during a winding process of the flexible layer, through compression by the pressure roller and the winding shaft, and the folding springs and the thin sheets of the flexible layer support structure are overlapped into the layer structure and then wound on the winding shaft; during a unwinding process of the flexible layer support structure, a part of the flexible layer support structure leaves the pressure roller and the winding shaft, and the folding springs unfold and prop open the thin sheets to restore a rigid and flat hollow thin-walled layer structure.

The flexible layer support structure of the present invention is an elastic structure enclosed by a curved elastic pieces of the folding springs and thin plates, which has a large bending moment of inertia and torsional moment of inertia and can be folded and bent.

When the surfaces of the thin sheets of the structure are subjected to sufficient overlapping pressure, each curved elastic piece are flatten along the overlapping surface into a overlapped thin sheet structure that can be bent or rolled up. After the overlapping pressure on the structure is removed, the structure quickly restores to the original hollow thin-walled elastic structure under the elastic action of the curved elastic pieces. The support concave layer formed by the curved elastic piece after the folding spring is restored provides sufficient support stiffness and protection for the flexible layer support structure. The elastic deformation of the folding springs occur in the space between the thin sheets, and does not cause deformation or displacement on the surface of the thin sheets of the flexible layer support structure.

The retractable device of the present disclosure connects one end at one direction of the flexible layer support structure to the winding shaft, and the first thin sheet and second thin sheet of the flexible layer support structure are folded and rolled up under the compression of the pressure roller. When retractable device is in use, the flexible layer support structure is unwound from the winding shaft, and the part that leaves the winding shaft is restored to a natural state of a flat hollow thin-walled structure with greater stiffness through the automatic elasticity of the folding springs, which has a very large storage ratio. At the same time, the flexible layer support structure after unwinding can withstand sufficient bending moments in the normal direction of the two thin sheets, and the flexible layer support structure in natural state has higher bending resistance and support stiffness. In addition, the mechanical engagement and friction force between the curved elastic pieces and the thin sheets, as well as between the curved elastic pieces, are increased by interlocking concave-convex structures in the folded and overlapped state, resisting the interlayer shear force of the flexible layer support structure during bending or winding, avoiding relative sliding between layers during the winding process, thereby improving the winding or bending performance of the flexible layer support structure in the folded and overlapped state.

Taking the flexible layer support structure of the thin sheets and the folding springs as the basic units, on the basis of ensuring local stiffness and not changing winding performance, multiple basic units are horizontally spliced into larger porous and retractable support structure panels, which are convenient for carrying flexible equipment such as flexible screens, flexible solar cells, satellite antennas, etc., achieving the expansion and installation of large flexible screens. When the flexible equipment needs to be used, the flexible layer support structure panel and the flexible equipment are pulled out or taken out from the winding shaft together. The elastic recovery force of the flexible layer support structure panel itself drives the flexible equipment to automatically flatten, providing sufficient support stiffness and overall protection for the flexible equipment. After the flexible equipment is used, the flexible equipment and the flexible layer support structure are rolled back onto the winding shaft together. Therefore, the flexible equipment using this structure occupies less space and is easy to store.

In summary, the technical solution provided by the present disclosure effectively solves the problems of the existing flexible screen support framework, such as a large number of components, complex structure, limited screen expansion, occupying space, and heavy self weight. The present disclosure can achieve the support structure to be rolled and unfolded together with flexible equipment, which is a lightweight and high stiffness support framework structure that is able to protect the entire surface, automatically flattened after unwinding, and rolled up freely. It has good application prospects in flexible equipment such as scroll screens, flexible solar cells, satellite antennas, etc.

BRIEF DESCRIPTION OF THE DRAWINGS

FIG. 22 is an overall structural diagram of the transverse splicing of a plurality of the flexible layer support structures in Embodiment 8.

LABELS IN THE DRAWINGS

1—first thin sheet, 2—second thin sheet, 3—intermediate layer, 5—first folding spring, 6—second folding spring, 7—gap, 9—strip flexible layer support structure, 10—panel flexible layer support structure;

11—first curved elastic piece, 12—second curved elastic piece, 13—third curved elastic piece, 14—fourth curved elastic piece, 15—fifth curved elastic piece, 16—sixth curved elastic piece, 17—seventh curved elastic piece, 18—eighth curved elastic piece, 19—side sealed folding spring;

21—first joint part, 22—second joint part, 23—third joint part, 24—fourth joint part, 25—fifth joint part, 26—sixth joint part;

31—convex tooth, 32—tooth slot, 3—shear key, 34—keyway, 35—keyhole; 41—winding shaft, 42—pressure roller; 51—first lap step, 52—second lap step, 53—third lap step, 54—fourth lap step.

DETAILED DESCRIPTION OF THE EMBODIMENTS

In order to make the technical problems, technical solutions and beneficial effects of the present invention clearer, the present invention will be further described in detail below with reference to the accompanying drawings and embodiments

Embodiment 1

Figure 1:
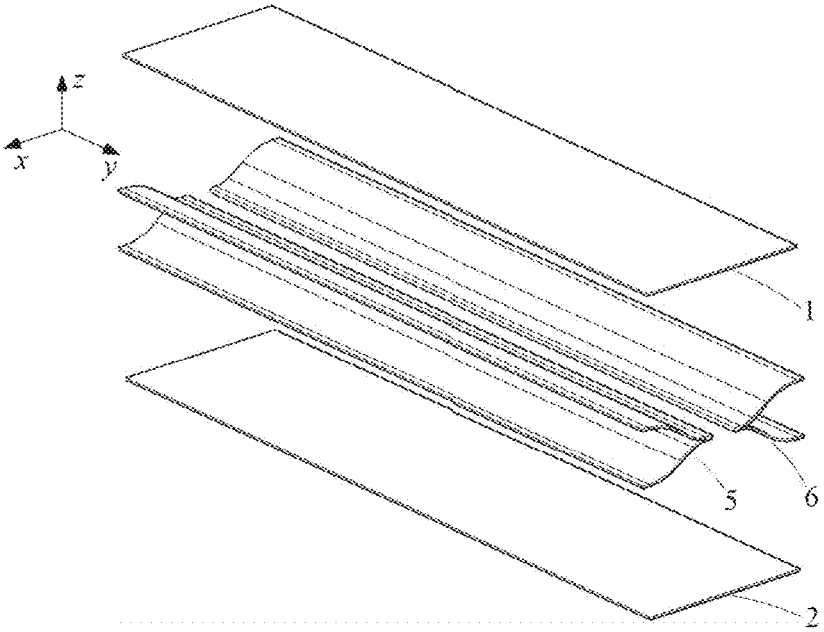
FIG. 1 is a schematic diagram of the decomposition of the flexible layer support structure in Embodiment 1.
Figure 2A:
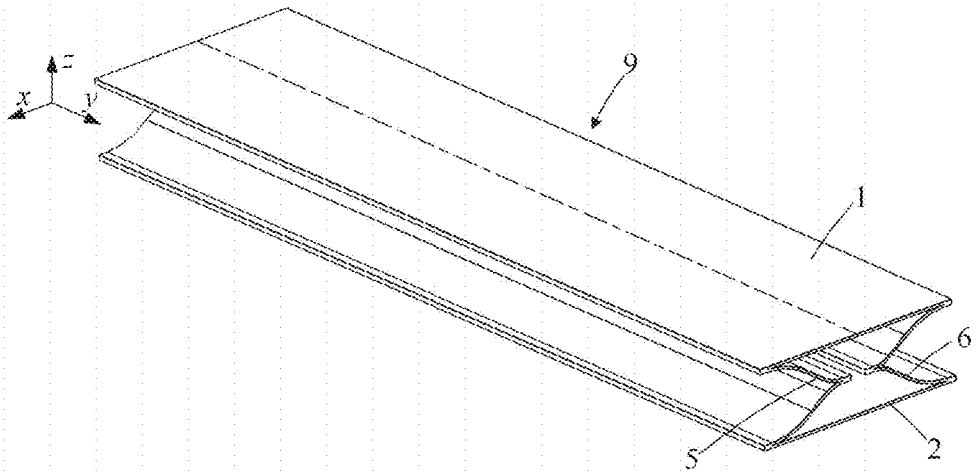
FIGS. 2*a* and 2*b* respectively show the three-dimensional views of the flexible layer support structure in Embodiment 1 under the natural state and folded and overlapped state of the thin sheets.

Referring to FIGS. 1 and 2*a*, the flexible layer support structure shown in the figure is a basic solution of the present disclosure. The strip flexible layer support structure 9 in this embodiment is a long strip foldable hollow thin-walled structure, which includes two thin sheets arranged in parallel with equally size, as well as two identical V-shaped folding springs sandwiched between the two in parallel. Both the thin sheets and the folding springs are elastic thin-walled components, wherein the shape of the thin sheets is a long rectangle, the folding springs are foldable strip-shaped compression springs, the direction of spring compression deformation is perpendicular to the thin sheets, and the deformation amount is the distance between the inner surfaces of the two thin sheets. Two folding springs are symmetrically arranged horizontally in the structure with openings facing outward. There is a certain distance between the two folding springs, which are not directly connected to each other, but are connected through two thin sheets. Both can be folded inward without mutual invasion or interference.

In order to facilitate a more accurate description of the strip flexible layer support structure 9 in this embodiment, a spatial three-dimensional coordinate system is established in the figure based on the longitudinal, transverse, and thickness directions of the strip flexible layer support structure 9. The x-axis is set as the transverse direction (the first direction) of the strip flexible layer support structure 9, the y-axis is set as the longitudinal direction (the second direction) of the strip flexible layer support structure 9, and the z-axis is the height direction (the third direction) of the strip flexible layer support structure 9.

Figure 2B:
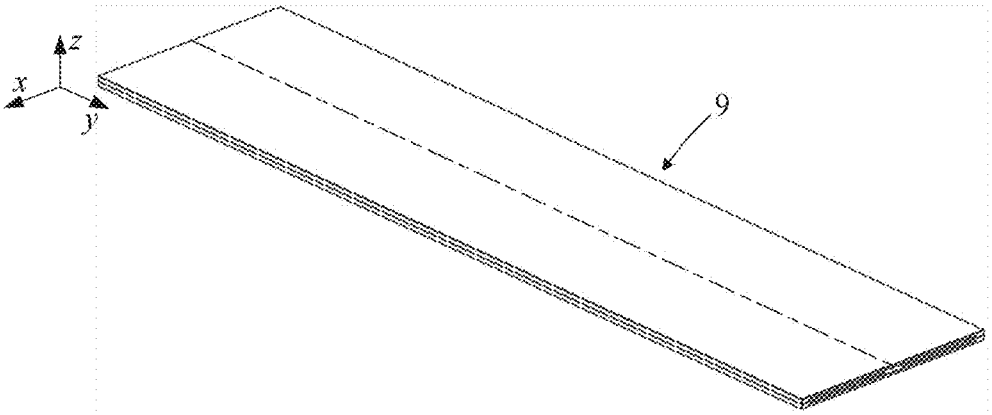

As shown in FIGS. 2*a* and 2*b*, the two thin sheets in the flexible layer support structure of this embodiment are respectively set as the first thin sheet 1 and the second thin sheet 2, and the two folding springs are respectively set as the first folding spring 5 and the second folding spring 6. The first folding spring 5 and the second folding spring 6 are arranged in parallel in the transverse direction of the strip flexible layer support structure 9. The first folding spring 5 and the second folding spring 6 are both sheet-shaped compression spring structures that continuously extend along the longitudinal direction of the strip flexible layer support structure 9. The two wing edges of the first folding spring 5 are aligned and lapped tangentially with the left inner surface edges of the two thin sheets, respectively. Similarly, the two wing edges of the second folding spring 6 are aligned and lapped tangentially with the right inner surface edges of the two thin sheets, respectively. These four thin-walled components are sequentially connected to form a flexible layer hollow thin-walled elastic structure with upper and lower surfaces arranged in parallel and both sides that are capable of being folded inward.

Figure 3:
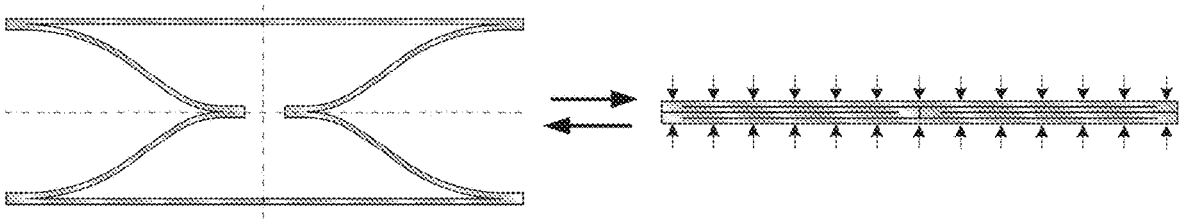
FIG. 3 is the mechanism diagram of the transformation between the natural state and the folded and overlapped state of the flexible layer support structure in Embodiment 1.

As shown in FIG. 2*a*, when the strip flexible layer support structure 9 is not subjected to external forces, the structure is in a natural state without deformation. When the folding springs of the structure are compressed under external force to achieve the overlapping between the first thin sheet 1 and the second thin sheet 2, that is, the structure is compressed to the folded and overlapped state, as shown in FIG. 2*b*. When the external force on the structure is removed, the folding springs elastically unfold to support two thin sheets, and the structure returns to its original shape, that is, its natural state. The structure transitions between the natural state and the folded and overlapped state are shown as FIG. 3. It can be seen that in the natural or folded and overlapped state, the projection of the first folding spring 5 and the second folding spring 6 on the first sheet 1 or the second sheet 2 does not exceed the outer contour of the two sheet surfaces, and there is no overlapping area of the projection of the two folding springs on the sheet surface. That is, the two folding springs occur in the projection area of the first thin sheet 1 and the second thin sheet 2, whether in compression or elastically propped open, which does not result in any changes in the external dimensions of the strip flexible layer support structure 9 and ensures comprehensive support for the entire flexible equipment.

Figure 4A:
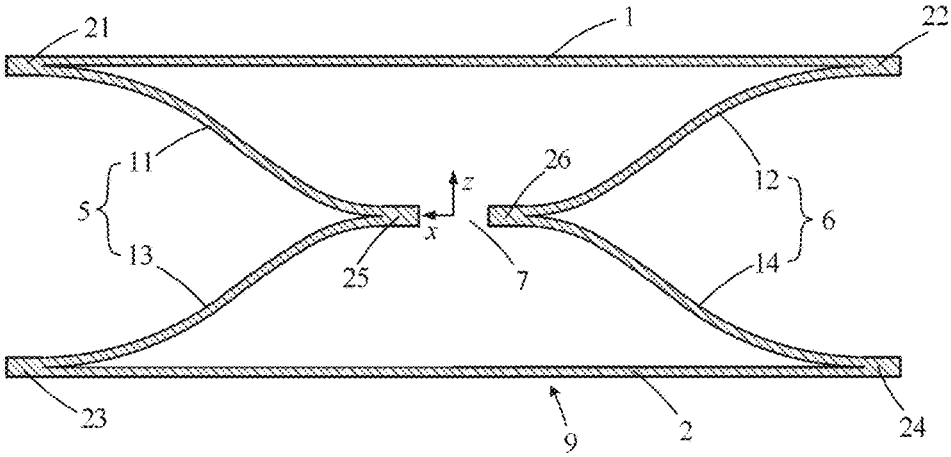
FIGS. 4*a* and 4*b* are cross-sectional views of the flexible layer support structure in Embodiment 1 in both natural state and folded and overlapped state.

The cross-section of the natural state of the strip flexible layer support structure 9 is shown in FIG. 4*a*. The specific structure of the two folding springs between the first thin sheet 1 and the second thin sheet 2 is as follows:

The first folding spring 5 includes a first curved elastic piece 11 and a third curved elastic piece 13 with the same thickness. The first curved elastic piece 11 and the third curved elastic piece 13 are both strip-shaped elastic sheets with the same longitudinal length as the strip flexible layer support structure 9. The cross-sectional centerline of the first curved elastic piece 11 is a smooth reverse S-shape, while the cross-sectional centerline of the third curved elastic piece 13 is a smooth S-shape. The two curved elastic pieces are symmetrically arranged on the xy plane (central overlapping plane) as the symmetrical plane. The side edge of the two is fixed and lapped with the central overlapping surface as the tangent plane to form the fifth joint part 25, forming a V-shaped folding spring with an opening facing left, and the other side edge of the two (the free side edge of the V-shaped folding spring) is aligned and lapped tangentially with the left edge of the first sheet 1 and the second sheet 2, forming the first joint part 21 and the third joint part 23, respectively. The bonding surfaces of the two joint parts are taken the lower surface of the first sheet 1 and the upper surface of the second sheet 2 as the tangent plane, respectively.

Similarly, the second folding spring 6 includes a second curved elastic piece 12 and a fourth curved elastic piece 14 with the same thickness, wherein the cross-sectional centerline of the second curved elastic piece 12 is a smooth S-shape, the cross-sectional centerline of the fourth curved elastic piece 14 is a smooth reverse S-shape, and the two curved elastic pieces are symmetrically arranged with the central overlapping plane as the symmetrical plane. The side edge of the two is fixed and lapped with the central overlapping plane as the tangent plane to form the sixth joint part 26, forming a V-shaped folding spring with an opening facing right, and the other side edge of the two are aligned and lapped tangentially with the right edge of the first thin sheet 1 and the second thin sheet 2, forming the second joint part 22 and the fourth joint part 24, respectively. The bonding surfaces of the two joint parts are taken the lower surface of the first thin sheet 1 and the upper surface of the second thin sheet 2 as the tangent plane, respectively.

The cross-sectional centerline of the curved elastic piece is formed by the tangent connection between the convex circular curve and the concave circular curve. The entire cross-sectional centerline is an S-shaped or reverse S-shaped smooth curve without any bending angle, and its two joint ends are set in a transitional tangent manner. In addition to using the smooth curves with constant curvature radius, smooth curves such as parabolas and transition curves with varying curvature radii can also be selected for smooth curves. A straight line segment that is tangent to the smooth curves can also be inserted between them, but the entire centerline must be a smooth curve without bending angles to avoid plastic deformation after the curved elastic pieces is flattened.

During the overlapping process of the strip flexible layer support structure 9 in this embodiment, the first joint part 21 and the second joint part 22, the third joint part 23 and the fourth joint part 24 connected on both sides of the thin sheets are fixed to the thin sheets, and the spacing between them remains unchanged, forming a fixed joint part. The fifth joint part 25 and the sixth joint part 26 of the folding springs relatively move close to each other in the transverse direction of the structure, and the width of the gap 7 between the two gradually decreases. Meanwhile, there is no relative displacement between the two in the height direction of the structure. After removing the overlapping force, the two fifth joint part and the sixth joint part are restored to the original position, and the width of the gap 7 returns to that of the original gap 7. Due to the relative movement of the fifth joint part 25 and the sixth joint part 26 in the transverse direction of the structure during the folding process of folding springs, they are also called free joint parts.

Figure 4B:
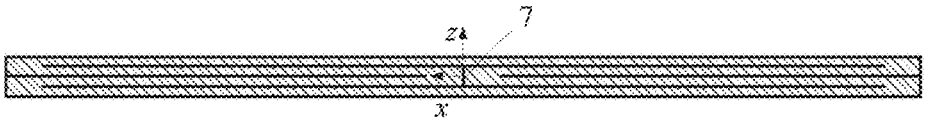

The cross section of the strip flexible layer support structure 9 in the folded and overlapped state is shown in FIG. 4*b*. The actual transverse width of each curved elastic piece after unfolding and flattening does not exceed half of the width of the thin sheet connected to it, or the sum of the flattened widths of two curved elastic pieces connected to the same thin sheet is not greater than the width of the thin sheet, that is, the width of gap 7 is not less than the sum of the maximum strokes of the fifth joint part 25 and the sixth joint part 26 on both sides. Alternatively, the sum of the flattened widths of all curved elastic pieces on the same layer+the gap width of all joint parts=the width of the corresponding connected thin sheet can achieve structural overlapping. When the width of gap 7 is equal to the sum of the strokes of the two free joint parts and the structure is overlapped, the two free joint parts exactly touch each other, as shown in FIG. 4*b*. However, the width of gap 7 can be appropriately greater than the sum of the strokes of the two free joint parts. This way, after the folding springs are compressed in place, there will be a certain amount of space between the fifth joint part 25 and the sixth joint part 26, which can be used to accommodate dust impurities between the thin sheets and avoid damage caused by direct contact and press of dust impurities with the thin sheets.

In the specific application of this embodiment, the curvature of the cross-section of the curved elastic piece and any point after bending or curling the thin sheet satisfies the following relationship:

$$\frac{1}{\rho} \leq \frac{2\sigma_e}{tE};$$

Wherein: t is a thickness of the curved elastic pieces or the thin sheets;

E is an elastic modulus of the curved elastic pieces or the thin sheets;

$\rho$ is a curvature radius of a neutral layer of a single curved elastic piece or a single thin sheet;

$\sigma_e$ is an elastic limit value of the curved elastic pieces or the thin sheets.

Optimizing the initial curvature or deformed curve of thin-walled components based on the above curvature expression can reduce the probability of plastic deformation of thin-walled components. All the joint parts between the curved elastic pieces and the thin sheets, as well as the joint parts between the curved elastic pieces, are set to be smooth and tangent connection, to avoid excessive stress at the joint parts during structural bending or curling, which may cause local deformation inconsistency or tearing failure.

In the strip flexible layer support structure 9 of this embodiment, thin-walled components such as curved elastic pieces or thin sheets are made of high elastic metals, high elastic polymers, fiber reinforced polymers, or metal wire skeleton reinforced polymer materials. Metal materials can be used such as stainless steel, memory alloys, titanium alloys and other alloys of high elasticity and high strength materials. The skeleton of metal wire are woven into curved elastic pieces or porous thin sheets. High-elastic low-plastic polymers can be used such as PEEK, TPE, PU, PET, and rubber polymers, and fiber reinforced polymers can be used such as glass fiber, carbon fiber, metal, and other fibre-reinforced high elasticity polymers.

The fixed bonding methods between the curved elastic pieces and the thin sheets, as well as between the curved elastic pieces, include bonding, welding, fusion, crimping or riveting. It is best to use binders with high strength and similar modulus to thin-walled components for bonding to ensure the quality of bonding. Metal materials can be welded or riveted, and materials such as high elastic polymers and fiber reinforced polymers can be bonded with adhesives or fused at high temperatures. In this embodiment, high-temperature fusion bonding is adopted, and all joint parts connect and combine the curved elastic piece with the curved elastic piece, and the curved elastic piece with the thin sheet as a whole.

Figure 5:
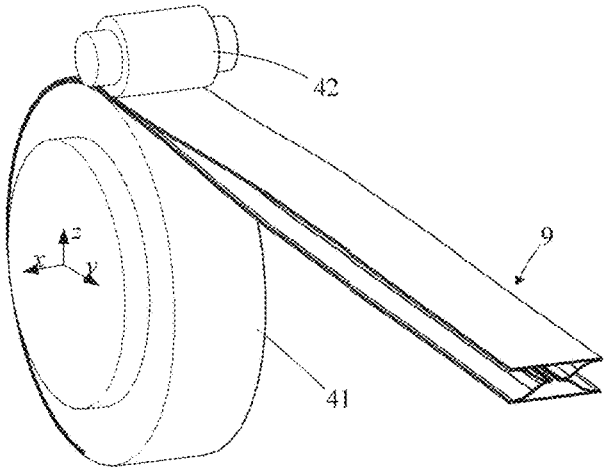
FIG. 5 is a schematic diagram of the flexible layer support structure in the wound state or unwound state in Embodiment 1.

Referring to FIG. 5, this embodiment also discloses a retractable device using the aforementioned strip flexible layer support structure 9, which includes a winding shaft 41, a pressure roller 42, and a strip flexible layer support structure 9 installed on the winding shaft 41. The flexible layer components using the strip flexible layer support structure 9 are wound on the winding shaft 41 to achieve the winding and unwinding of the entire structure.

During the winding process, the flexible layer components of the strip flexible layer support structure 9 pass through the gap between the pressure roller 42 and the winding shaft 41 to be wound on the winding shaft 41. The gap formed between the circumferential surface of the pressure roller 42 and the winding circumferential surface of the winding shaft 41 corresponds to the thickness of the strip flexible layer support structure 9 in the folded and overlapped state, which is smaller than the thickness when the strip flexible layer support structure 9 are unwound in the natural state. The part of the flexible layer components near the winding shaft 41 is compressed by the pressure roller 42, so that the folding spring is compressed, and the two thin sheets gradually come close to each other. And the closer to the structural part of the winding shaft 41 and the pressure roller 42, the smaller the height of the structural part. Finally, under the compression of the winding shaft 41 and the pressure roller 42, the thin sheets and the folding springs in this structural part are pressed into a folded and overlapped state. At this time, the bending moment of inertia of the cross-section around the x-axis in this structural part is minimized, becoming very soft, and can be wound on the winding shaft 41 with designed minimum radius, and it is easier to be wound if the thin-walled components are thinner.

The winding shaft 41 is a winding shaft for the flexible layer. The pressure roller 42 conducts pre-pression to the flexible layer before winding it onto the winding shaft 41. A gap for pre-pression to the flexible layer may be formed between the pressure roller 42 and the winding shaft 41, or two sets of the pressure rollers 42 arranged in parallel can be used to form a separate gap for pre-pression.

During the unwinding process, for the structure part of the strip flexible layer support structure 9 leaves from the winding shaft 41 and the pressure roller 42, the elastic force of the folding springs pushes and props the upper and lower thin sheets open, and the structure automatically straightens and restores to a natural state with a certain rigid, which is a hollow thin-walled structure with flat upper and lower surfaces. At this point, the structural part that returns to its natural state can withstand the transverse bending moment around the x-axis and the axial pressure along the longitudinal y-axis. Even if the structure exceeds the ultimate bearing capacity of the structure under external loads, the compression and folding of folding springs causes the overall instability of the strip flexible layer support structure 9, thereby leading to the overlapping and bending of the strip flexible layer support structure 9, to release the influence of external loads and avoid structural damage.

In order to elastically restore the curled or bent strip flexible layer support structure 9 to its original natural shape without curling, that is, the structure deforms within the elastic range, the radius of the winding shaft 41 should be greater than or equal to the minimum design radius of the structure. This curling radius should ensure that every part of the structure after curling should be in an elastic deformation state, otherwise it will cause plastic deformation or damage to the structure, and cannot restore its original shape.

When the retractable device of this embodiment is in use, the strip flexible layer support structure 9 in the wound and folded and overlapped state is pulled out from the winding shaft 41 or unwound from the turntable, and the elastic recovery force of the folding springs in the structural part that leaves the winding shaft 41 automatically straightens, flattening into a flat surface structure with a large bending and torsional r, moment of inertia, which can withstand large bending moments and axial pressure without instability or damage. After the structure is used, it is rolled back onto the winding shaft 41, so the space occupied by the retractable device is small and easy to store.

Figure 6A:
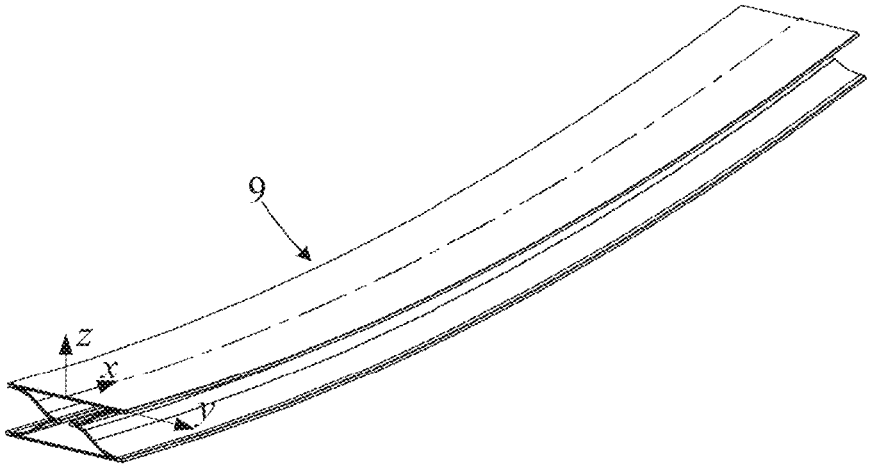
FIGS. 6*a* and 6*b* are schematic diagrams of the flexible layer support structure of the out-of-plane bending type and the in-plane bending type in Embodiment 1, respectively.
Figure 6B:
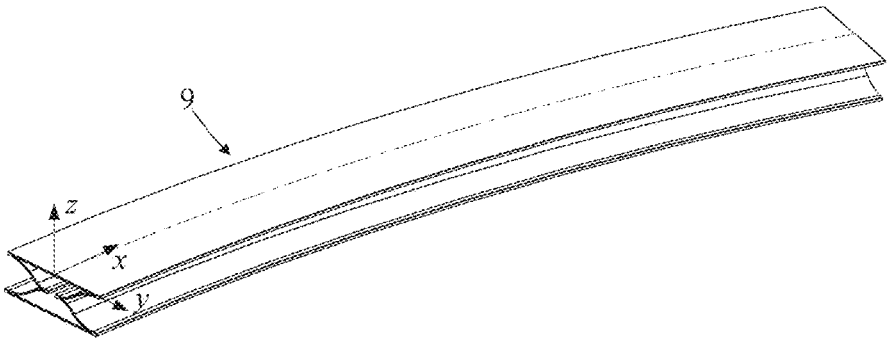

The shape from longitudinal direction of the strip flexible layer support structure 9 in this embodiment is an equal height and long straight shape, which is suitable for flexible structures such as straight-screens. Similarly, by adjusting the shape of the folding springs and the thin sheets, it can be constructed into an arc shape that is bent in the plane or an arc shape that is bent out of the plane to accommodate and meet different flexible equipment requirements. FIG. 6*a* shows that the bending direction of the strip flexible layer support structure 9 is in the xz plane, which is suitable for flexible devices such as curved-screens. FIG. 6*b* shows that the bending direction of the strip flexible layer support structure 9 is in the xy plane, which is suitable for flexible devices such as sector-shaped screen.

Embodiment 2

Figure 7A:
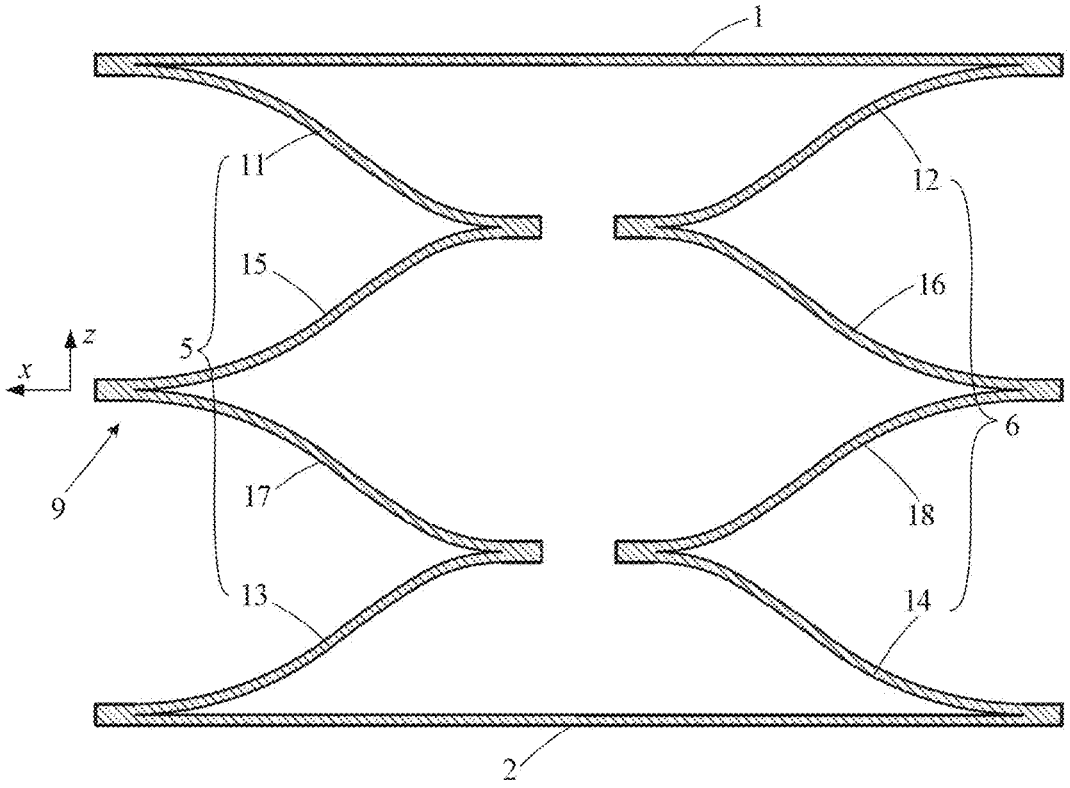
FIGS. 7*a* and 7*b* are cross-sectional views of a flexible layer support structure in Embodiment 2 in both natural state and folded and overlapped state.
Figure 7B:
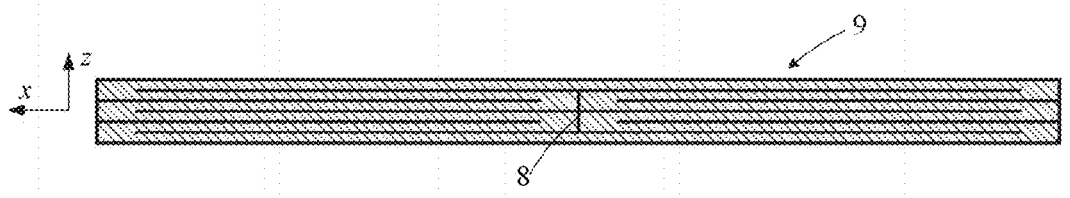

Referring to FIGS. 7*a* and 7*b*, the strip flexible layer support structure 9 shown in the figure is another specific embodiment of the present disclosure. This embodiment is based on Embodiment 1, and the difference between Embodiment 1 and Embodiment 2 is that the first folding spring 5 and the second folding spring 6 in this embodiment are respectively connected in series by two V-shaped folding springs, forming a spring group, that is to say, each folding spring group is composed of four curved elastic pieces connected in series along the height direction of the flexible layer, and the compression deformation direction is also the height direction of the structure. In the series connection, the deformation of the spring group is the sum of all individual spring deformations, and the load is the same as that of a single spring, while in the parallel connection, the deformation of the spring group is the same as that of a single spring, and the load is the sum of the loads of all individual springs.

Furthermore, in this embodiment, the four outer side edges of the first curved elastic piece 11, the second curved elastic piece 12, the third curved elastic piece 13, and the fourth curved elastic piece 14 in the first folding spring 5 are fixedly connected with the four outer side edges of the first thin sheet 1 and the second thin sheet 2 to form a fixed joint part. A fifth curved elastic piece 15 and a seventh curved elastic piece 17 are added between the first curved elastic piece 11 and the third curved elastic piece 13 of the first folding spring 5. A sixth curved elastic piece 16 and an eighth curved elastic piece 18 are added between the second curved elastic piece 12 and the fourth curved elastic piece 14 of the second folding spring 6. One side edge of the fifth curved elastic piece 15 and one side edge of the seventh curved elastic piece 17 are fixedly connected with the other side edge of the first curved elastic piece 11 and the other side edge of the third curved elastic piece 13 to form two free joint parts, and the other side edge of the fifth curved elastic piece 15 and the other side edge of the seventh curved elastic piece 17 are connected to form a free joint part. One side edge of the sixth curved elastic piece 16 and one side edge of the eighth curved elastic piece 18 are fixedly connected with the other side edge of the second curved elastic piece 12 and the other side edge of the fourth curved elastic piece 14 to form two free joint parts, and the other side edge of the sixth curved elastic piece 16 and the other side edge of the eighth curved elastic piece 18 are connected to form a free joint part. In the folding spring arrangement of this embodiment, along the height direction of the strip flexible layer support structure 9, by increasing the number of V-shaped folding springs or curved elastic pieces, the cross-sectional height of the structure is increased without changing the spring load, thereby increasing the bending stiffness of the structure.

Figure 8A:
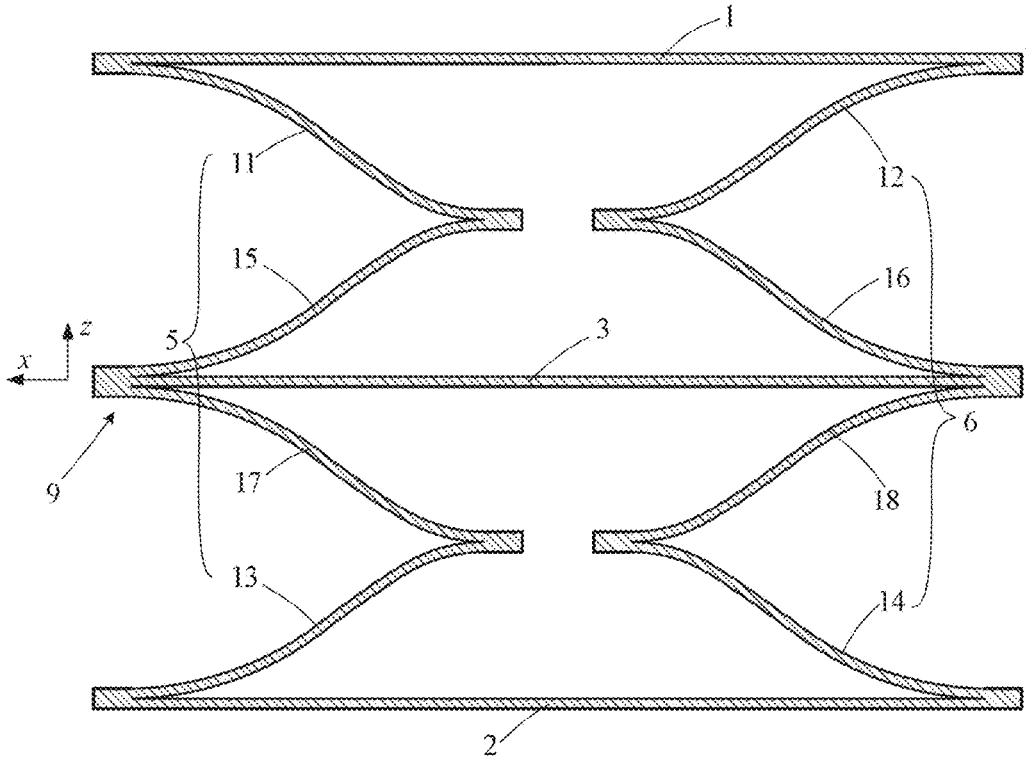
FIGS. 8*a* and 8*b* are cross-sectional views of another flexible layer support structure in Embodiment 2 in both natural state and folded and overlapped state.
Figure 8B:
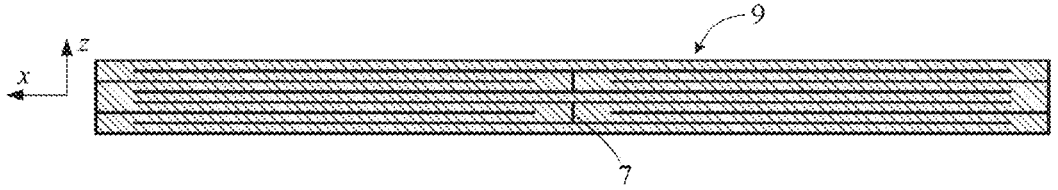

Furthermore, this embodiment takes into account that the curved elastic pieces located between the two sets of folding springs is not directly connected to the thin sheet, and the free joint part between the fifth curved elastic piece 15 and the seventh curved elastic piece 17, as well as the free joint part between the sixth curved elastic piece 16 and the eighth curved elastic piece 18, is prone to instability and displacement to both sides during the folding and compression process, an intermediate layer 3 parallel to the first thin sheet and second thin sheet between two parallel folding spring groups, as shown in FIGS. 8*a* and 8*b*. The free joint part between the fifth curved elastic piece 15 and the seventh curved elastic piece 17, as well as the free joint part between the sixth curved elastic piece 16 and the eighth curved elastic piece 18, are fixedly provided with the two sides of the intermediate layer 3, and the two free joint parts are transformed into fixed joint parts that are relatively fixed in the transverse direction of the structure between the intermediate layer and the thin sheets. Therefore, adding an intermediate layer between the folding spring groups is equivalent to forming a multi-layer thin sheet-folding spring group structure, increasing the structural support stability of the multi-layer folding spring group.

This embodiment increases the number of curved elastic pieces in the deformation direction of the folding spring, without changing the load conditions of the folding spring, the deformation variable of the folding spring and the height of the structure are increased, thereby enhancing the bending performance and stiffness of the structure.

Embodiment 3

Figure 9A:
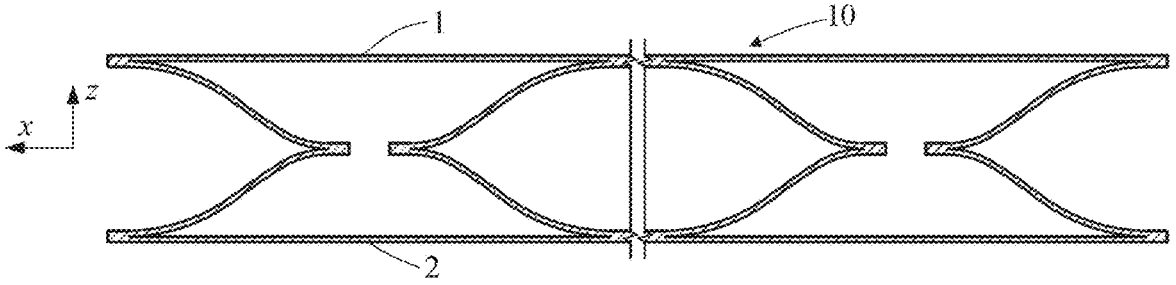
FIGS. 9*a* and 9*b* are cross-sectional views of the flexible layer support structure panel in Embodiment 3 in both natural state and folded and overlapped state.
Figure 9B:
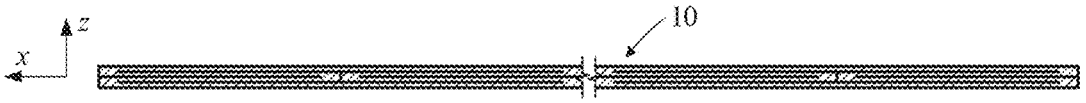

Referring to FIGS. 9*a* and 9*b*, the panel flexible layer support structure 10 shown in the figure is another specific embodiment of the present disclosure. In this embodiment, based on the strip flexible layer support structure 9 in Embodiment 1, more number of folded springs are sandwiched between the wider thin sheet groups in the transverse direction of the structure, forming a panel flexible layer support 10 with a wider size in the transverse direction. The longitudinal size of its structure can be adapted by adjusting the longitudinal length of the curved elastic piece, which can be used to form a flexible layer support for the panel.

Figure 10:
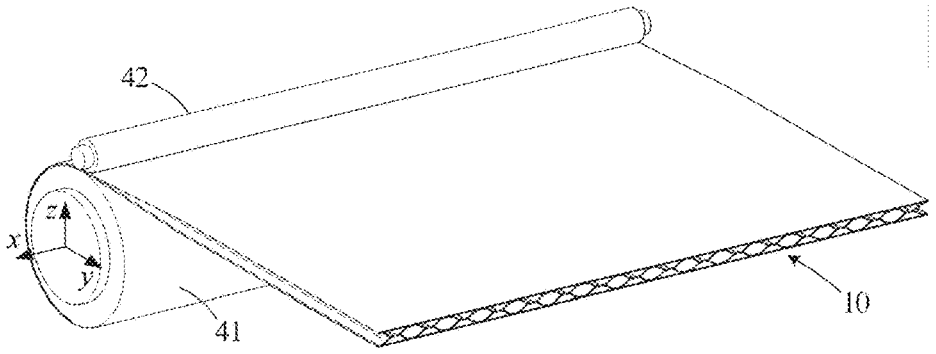
FIG. 10 is a schematic diagram of the flexible layer support structure panel in the wound state or unwound state in Embodiment 3.

Referring to FIG. 10, this embodiment also discloses a retractable device for the panel flexible layer support structure 10, which includes a winding shaft 41, a pressure roller 42, and a panel flexible layer. The panel flexible layer adopts the panel flexible layer support structure 10 of this embodiment, including the first thin sheet 1 and the second thin sheet 2 which are overlapped with each other, as well as several folding springs arranged in pairs horizontally along the structure between the first thin sheet 1 and the second thin sheet 2. The axial length of the winding shaft 41 matches the width of the panel flexible layer support structure 10. The panel flexible layer support structure 10 is wound on the winding shaft 41 to achieve the winding and unwinding of the entire support structure. The connection method between each folding spring and the thin sheets, as well as the arrangement of the pressure roller 42 and the winding shaft 41, can refer to Embodiment 1 and Embodiment 2.

Embodiment 4

Figure 11A:
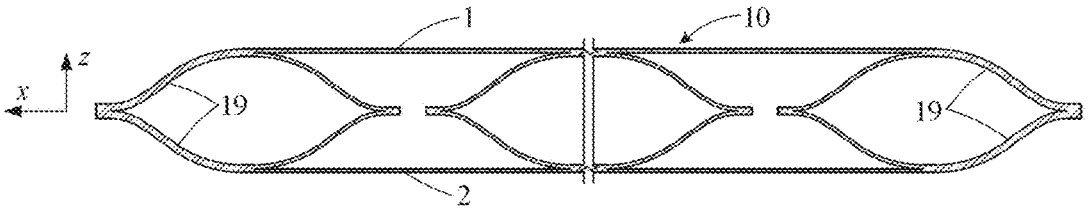
FIGS. 11*a* and 11*b* are cross-sectional views of the flexible layer support structure panel in Embodiment 4 under natural state and folded and overlapped state, respectively.
Figure 11B:
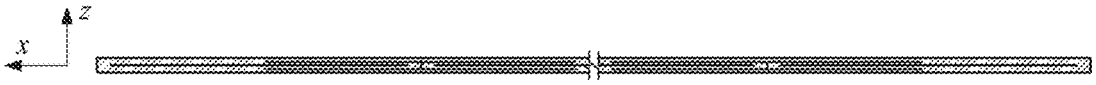

Referring to FIGS. 11*a* and 11*b*, the panel flexible layer support structure 10 shown in the figure is another specific embodiment of the present disclosure. Based on the panel flexible layer support structure 10 in Embodiment 3, the first thin sheet 1 and the second thin sheet 2 of the panel flexible layer support structure 10 are respectively fixed and connected with side sealed folding springs 19 at the two sides along the second direction. The side sealed folding spring 19 on the same side of the first thin sheet 1 and the second thin sheet 2 extends outward and is fixedly connected, so that the panel flexible layer support structure 10 seals the side gap formed between the curved elastic pieces on the side of the first thin sheet 1 and the second thin sheet 2 when the first thin sheet 1 and the second thin sheet 2 are in an open state.

During the use of the panel flexible layer support structure 10 in Embodiment 3, debris is easily trapped in the joints formed by the two pairs of curved elastic pieces on the outer side. If not cleaned in a timely manner before winding, it will affect the bending performance of the structure. This embodiment adds a pair of side sealed folding springs 19 on both sides of the panel flexible layer support structure 10 to prevent debris from being trapped in the exposed joints of the panel flexible layer support structure 10. The structure of the side sealed folding spring 19 is the same as that of the folding spring between the first thin sheet and second thin sheet. It is symmetrically arranged with the outermost folding spring between the adjacent the first thin sheet 1 and the second thin sheet 2. By sealing the edges of the panel flexible layer support structure 10, it can also form auxiliary support for the side edges of the first thin sheet 1 and the second thin sheet 2. The side sealed folding spring 19 extends completely beyond the area of the first thin sheet 1 and the second thin sheet 2, and is not flush with the surface of the thin sheet when the first thin sheet 1 and the second thin sheet 2 are stretched apart. Therefore, the area of the side sealed folding spring 19 may not be considered as a surface layer for the panel flexible layer support structure 10.

The side sealed folding springs 19 can also be arranged in the strip flexible layer support structure 9 of Embodiment 1 and Embodiment 2.

Embodiment 5

Figure 12A:
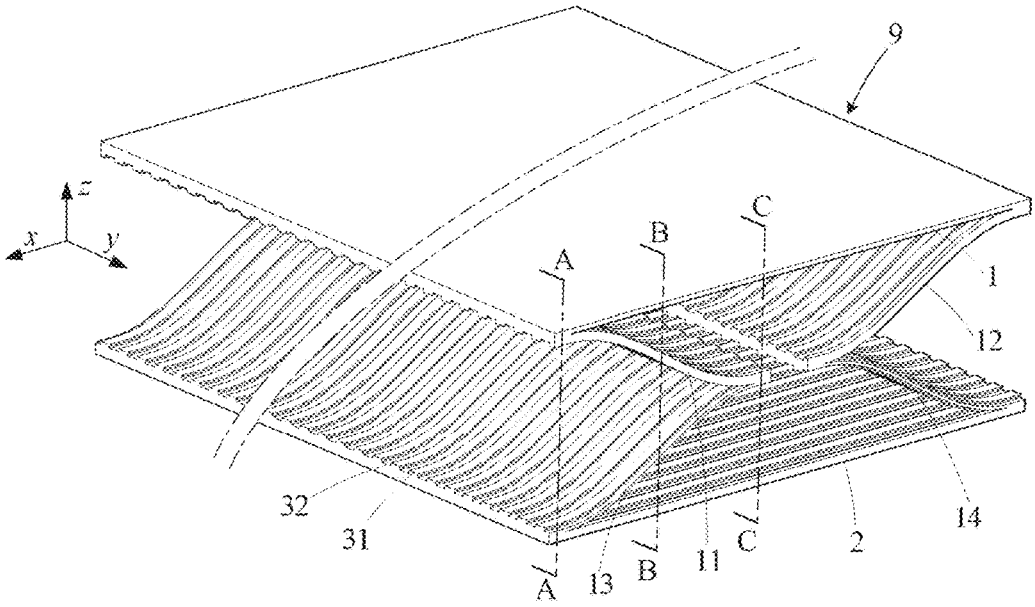
FIGS. 12*a* and 12*b* are isometric views of the flexible layer support structure in Embodiment 5 under natural state and folded and overlapped state, respectively.
Figure 12B:
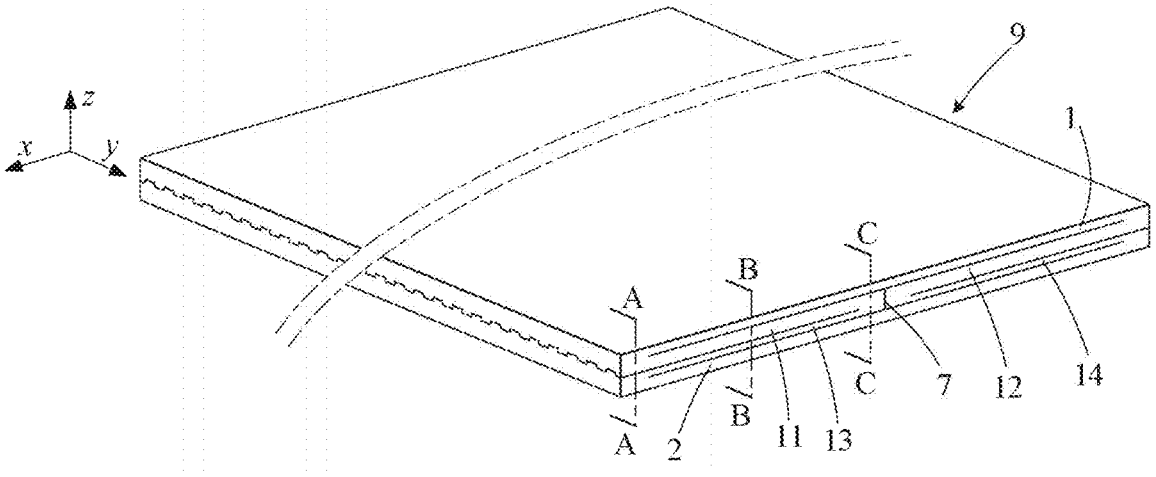

Referring to FIGS. 12*a* and 12*b*, a strip flexible layer support structure 9 in the figure is a further preferred solution for Embodiment 1. In the Embodiment 1, both surfaces of the thin sheet and curved elastic piece are smooth. When the flexible layer support structure in the folded and overlapped state bends or curls, the interlayer shear force is transferred laterally within the plane of each curved elastic piece, and the transfer path is transferred laterally from the center of the curved elastic piece to the joint of the curved elastic piece, then, horizontally transmitted to the joint of the curved elastic piece and the curved elastic piece on the central overlapping plane. Due to the thin thickness of the thin sheet in the structure and the out-of-plane instability, after the structure is bent, the closer it is to the curved elastic pieces and joint parts of the axis in the structural section, the greater its shear force, and the distribution is uneven, resulting in inconsistent local deformation and accumulation of longitudinal deformation. Therefore, in this case of a farther force transmission path, it is easy to appear out-of-plane instability or deformation is too large to yield, and it is difficult to make the overlapped structure fit the winding shaft to roll up, greatly affecting the bending and winding performance of the structure. In particular, when the width of the strip flexible layer support structure 9 is larger and the curling radius is smaller, the interlayer shear force of the thin-walled component will be larger, and it will be easier to have out-of-plane deformation or instability, and the various layers of curved surface elastic pieces can not be tightly overlapped. Even if bent within the elastic range, it cannot be uniformly attached on the winding shaft 41, which can easily cause uneven deformation of the flexible equipment and cause damage.

On the basis of the strip flexible layer support structure 9 in the above embodiment, concave-convex structures that engage with each other in the folded and overlapped state of the strip flexible layer support structure 9 are set on the curved elastic piece of the folding spring, the first thin sheet, and the second thin sheet. After the first thin sheet and the second thin sheet are folded, the mechanical biting force and friction force between the layers are improved through the interlocking concave-convex structures, and the interlayer shear force of the entire structure wound on the winding shaft are offset.

In this embodiment, the various parts of the strip flexible layer support structure 9 are longitudinally cut in parallel to the yz plane of the flexible layer, with the cutting positions shown in FIGS. 12*a* and 12*b*. Due to the symmetry of the cross section of the structure, only one side of the first folding spring is cut in this embodiment. The structure of the second folding spring is symmetrical with the first folding spring, and the A-A section is obtained by vertically cutting through the first joint part 21 and the third joint part 23, the B-B section is obtained by vertically cutting the structure between the first joint part 21 and the fifth joint part 25, and the C-C section is obtained by vertically cutting the fifth joint part 25.

Figure 13A:
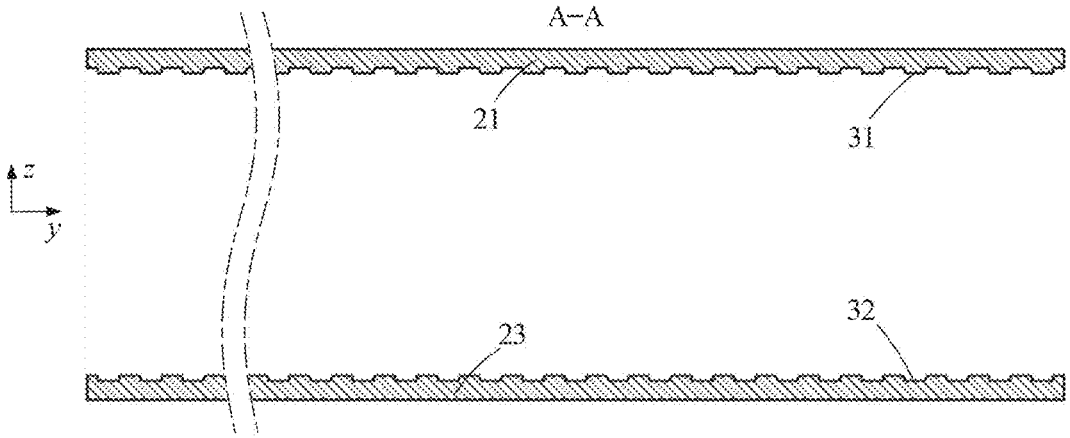
FIGS. 13*a* and 13*b* are the A-A longitudinal section views of the flexible layer support structure in the natural state and folded and overlapped state of Embodiment 5, respectively.
Figure 13B:
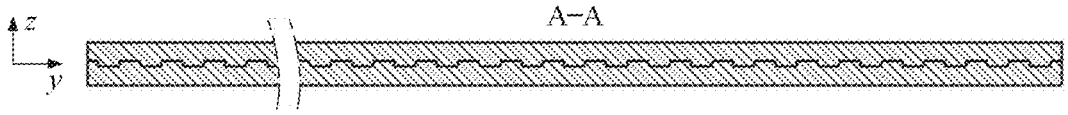

As shown in FIGS. 13*a* and 13*b*, in the longitudinal cross-sectional view of part A of the first joint part 21 and third joint part 23, continuous convex teeth 31 and tooth slots 32 are alternately arranged along the y-axis longitudinal direction of the strip flexible layer support structure 9 on the contact surface of the two sets of curved elastic pieces that are folded and overlapped, extending to the joint parts at both ends. The convex teeth 31 and tooth slots 32 are respectively staggered on the surface of the curved elastic piece. After the first joint part 21 and the third joint part 23 are overlapped on the strip flexible layer support structure 9, the convex teeth 31 and the tooth slots 32 on them are engage with each other.

Figure 14A:
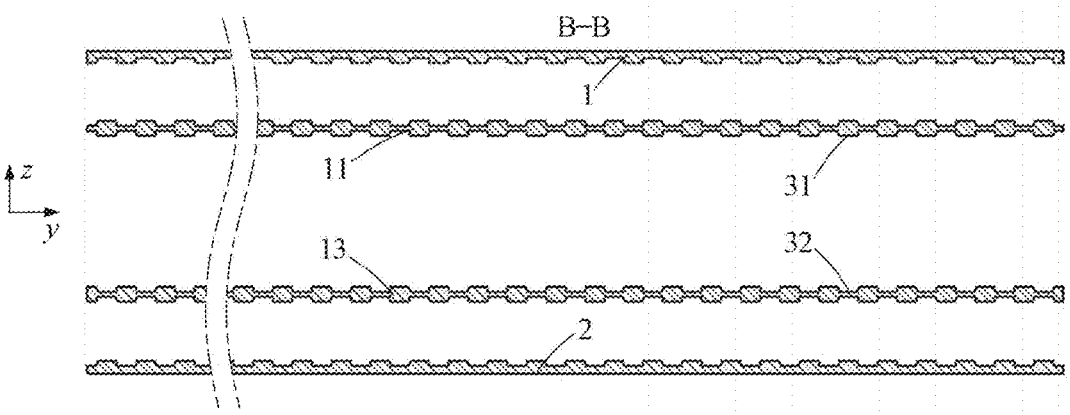
FIGS. 14*a* and 14*b* are the B-B longitudinal section views of the flexible layer support structure in Embodiment 5 under natural state and folded and overlapped state, respectively.
Figure 14B:
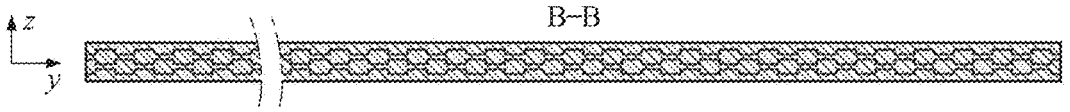

As shown in FIGS. 14*a* and 14*b*, similarly, in the longitudinal cross-sectional view of part B, on the contact surface where the first thin sheet 1 and the first curved elastic piece 11 are folded and overlapped, continuous convex teeth 31 and tooth slots 32 are alternately distributed along the longitudinal direction of the strip flexible layer support structure 9; on the contact surface where the first curved elastic piece 11 and the third curved elastic piece 13 are folded and overlapped, continuous convex teeth 31 and tooth slots 32 are alternately distributed along the longitudinal direction of the strip flexible layer support structure 9; and on the contact surface where the third curved elastic piece 13 and the second thin sheet 2 are folded and overlapped, continuous convex teeth 31 and tooth slots 32 are alternately distributed along the longitudinal direction of the strip flexible layer support structure 9. The convex teeth 31 and tooth slots 32 on the contact surface are respectively distributed in a staggered manner. In the folded and overlapped state, the convex teeth 31 and tooth slots 32 on the contact surfaces of the thin-walled components in the strip flexible layer support structure 9 are engaged with each other.

Figure 15A:
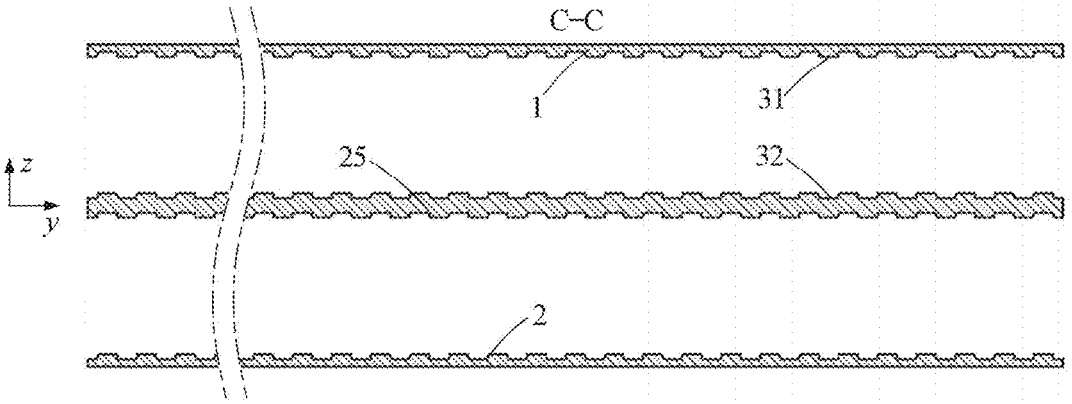
FIGS. 15*a* and 15*b* are the C-C longitudinal section views of the flexible layer support structure in Embodiment 5 under natural state and folded and overlapped state, respectively.
Figure 15B:
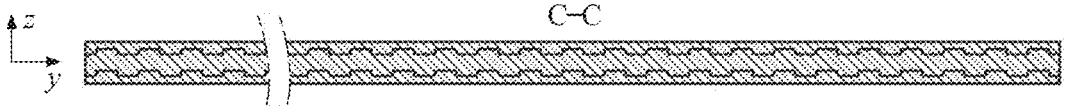

As shown in FIGS. 15*a* and 15*b*, in the longitudinal cross-sectional view of part C, continuous convex teeth 31 and tooth slots 32 are alternately distributed along the longitudinal direction of the structure on the contact surface where the first thin sheet 1 and the fifth joint part 25 are folded and overlapped. On the contact surface where the second thin sheet 2 and the fifth joint part 25 are folded and overlapped, continuous convex teeth 31 and tooth slots 32 are alternately distributed along the longitudinal direction of the structure. The convex teeth 31 and tooth slots 32 on the face-to-face contact surface are distributed in a staggered manner. In the folded and overlapped state, the convex teeth 31 and tooth slots 32 on each contact surface of the thin-walled component in the strip flexible layer support structure 9 are engaged with each other. The interlocking of convex teeth and tooth slots on the contact surface between each layer of thin-walled components resists interlayer shear force. Due to the direct transmission of shear force through the vertical panel surface, the transmission path is very short, and the interlayer shear force is quickly offset. Moreover, the shear stress and uneven deformation will be reduced. Even thin-walled components with extremely small thickness and extremely large width can be folded and rolled freely, making it less prone to out of plane instability and inability to curl normally.

Embodiment 6

Figure 16A:
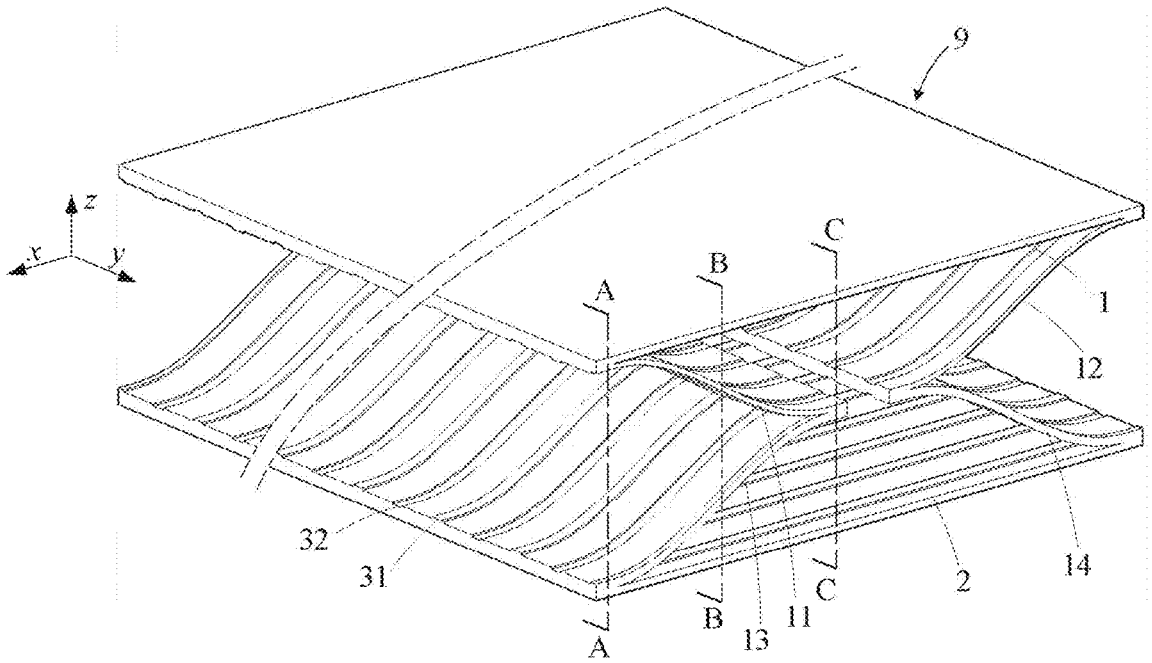
FIGS. 16*a* and 16*b* are isometric views of the flexible layer support structure in Embodiment 6 under natural state and folded and overlapped state, respectively.
Figure 16B:
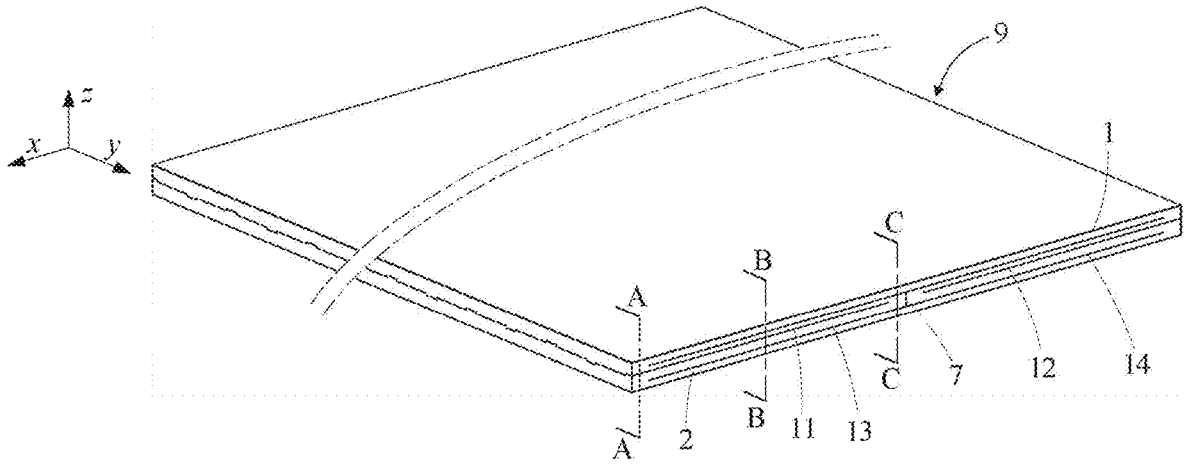

Referring to FIGS. 16*a* and 16*b*, a strip flexible layer support structure 9 in the figure is another preferred embodiment of the concave-convex structures in Example 5. This embodiment also sets continuous convex teeth 31 and tooth slots 32 along the longitudinal direction of the structure on the surfaces of two sets of curved elastic pieces that are overlapped face-to-face. Unlike Embodiment 5, the arrangement of the convex teeth and tooth slots in this embodiment on the surface of the curved elastic pieces or thin sheets is not closely distributed, but there is a certain spacing, which is incomplete tooth patterns.

Figure 17A:
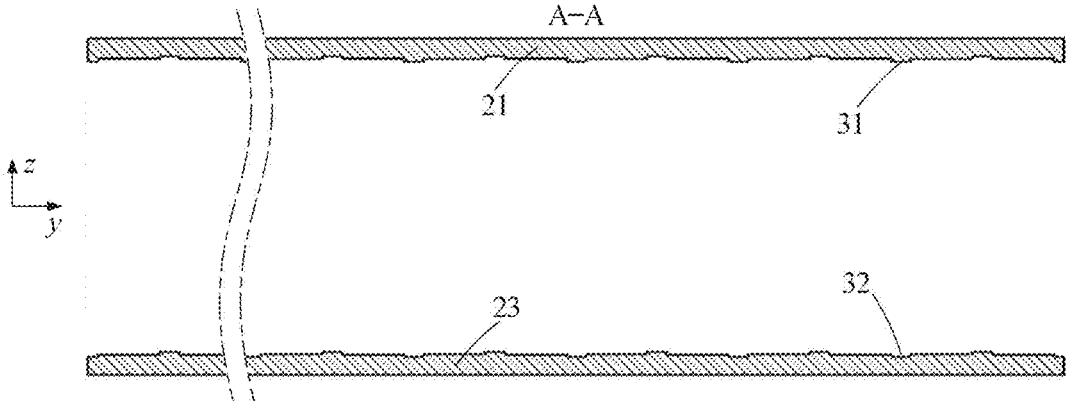
FIGS. 17*a* and 17*b* are the A-A longitudinal section views of the flexible layer support structure in Embodiment 6 under natural state and folded and overlapped state, respectively.
Figure 17B:
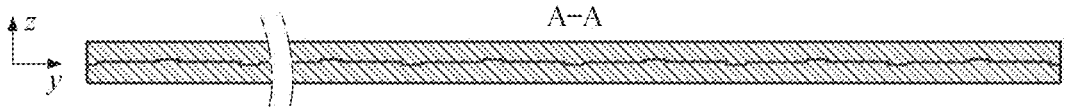

As shown in FIGS. 17*a* and 17*b*, in the longitudinal cross-sectional view of part A of the first joint part 21 and the third joint part 23, continuous convex teeth 31 and tooth slots 32 are distributed along the longitudinal direction of the structure on the contact surfaces of the first joint part 21 and the third joint part 23. The convex teeth 31 and tooth slots 32 are alternately distributed on the same surface, and the convex teeth 31 and tooth slots 32 on the contact surfaces are engaged one by one in the folded and overlapped state. After the first joint part 21 and the third joint part 23 are folded with the flexible layer support structure, the convex teeth 31 and the tooth slots 32 on the surfaces are engaged with each other.

Figure 18A:
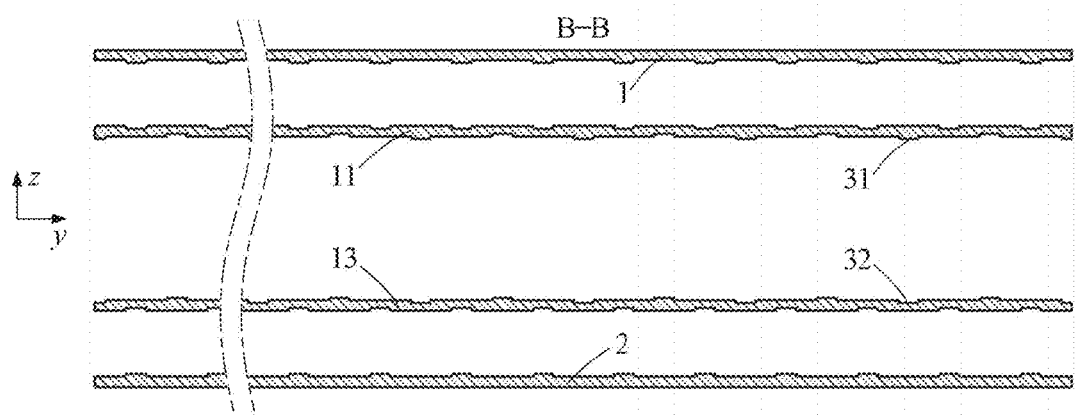
FIGS. 18*a* and 18*b* are the B-B longitudinal section views of the flexible layer support structure in Embodiment 6 under natural state and folded and overlapped state, respectively.
Figure 18B:
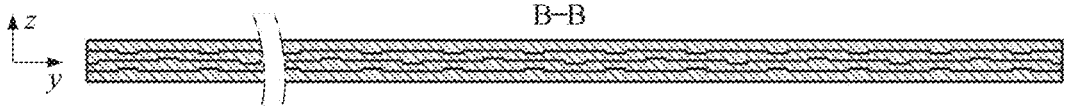

As shown in FIGS. 18*a* and 18*b*, in the longitudinal section view of part B, on the surface where the first thin sheet 1 and the first curved elastic piece 11 are folded and overlapped, continuous convex teeth 31 and tooth slots 32 are alternately distributed along the longitudinal direction of the structure; on the surface where the first curved elastic piece 11 and the third curved elastic piece 13 are folded and overlapped, continuous convex teeth 31 and tooth slots 32 are alternately distributed along the longitudinal direction of the structure; and on the surface where the third curved elastic piece 13 and the second thin sheet 2 are folded and overlapped, continuous convex teeth 31 and tooth slots 32 are alternately distributed along the longitudinal direction of the structure. The convex teeth 31 and tooth slots 32 are alternately distributed on the same surface with a certain distance, and the convex teeth 31 and tooth slots 32 on the opposite surface are engaged one by one in the folded and overlapped state.

Figure 19A:
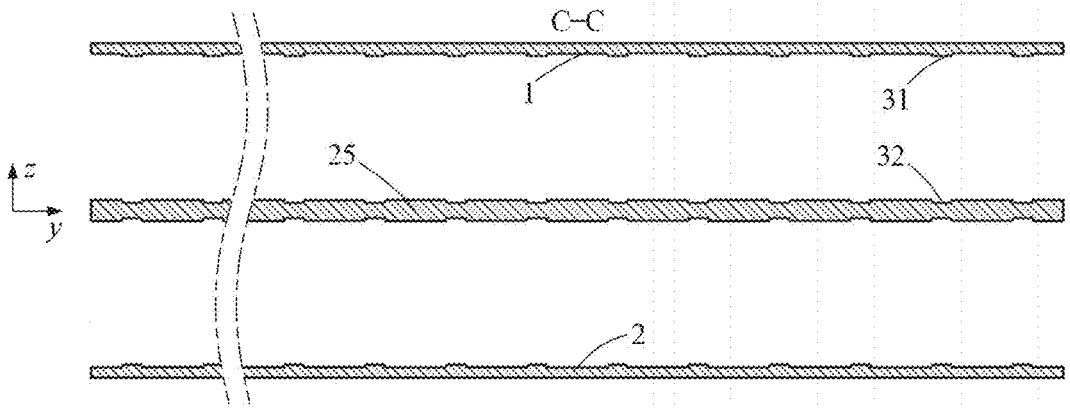
FIGS. 19*a* and 19*b* are the C-C longitudinal section views of the flexible layer support structure in Embodiment 6 under natural state and folded and overlapped state, respectively.
Figure 19B:
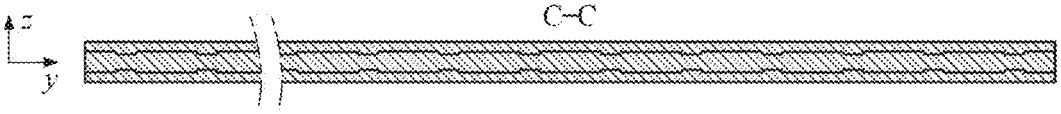

As shown in FIGS. 19*a* and 19*b*, in the longitudinal section view of part C, on the surface where the first thin sheet 1 and the fifth joint part 25 are folded and overlapped, continuous convex teeth 31 and teeth slots 32 are alternately distributed along the longitudinal direction of the structure; on the surface where the second thin sheet 2 and the fifth joint part 25 are folded and overlapped, continuous convex teeth 31 and tooth slots 32 are alternately distributed along the longitudinal direction of the structure. The convex teeth 31 and tooth slots 32 are alternately distributed on the same surface, and the convex teeth 31 and tooth slots 32 on the opposite surface are engaged one by one in the folded and overlapped state.

Embodiment 7

Figure 20A:
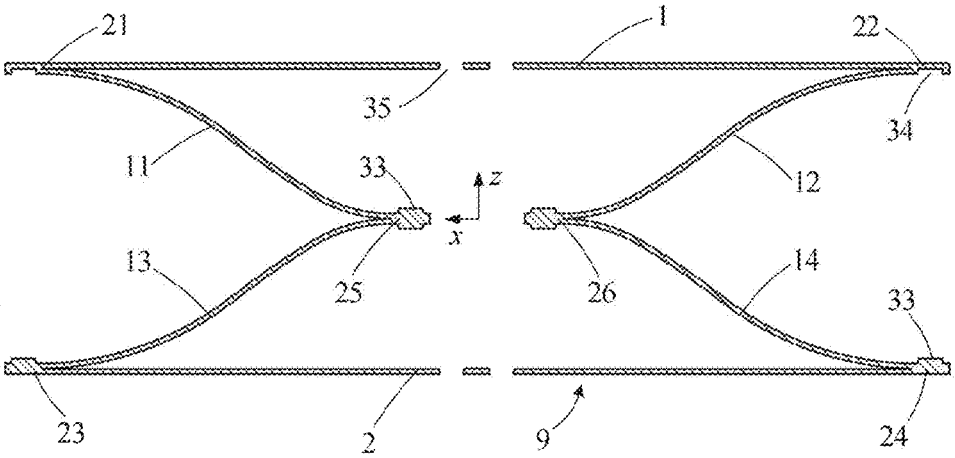
FIGS. 20*a* and 20*b* are cross-sectional views of the flexible layer support structure in Embodiment 7 in both natural state and folded and overlapped state.
Figure 20B:
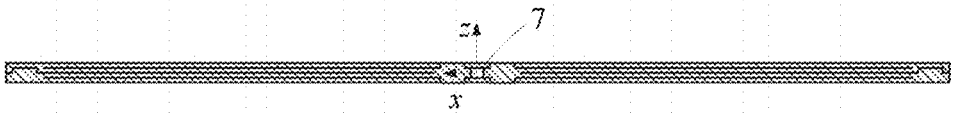

Referring to FIGS. 20*a* and 20*b*, the strip flexible layer support structure 9 shown in the figure is another implementation solution of the concave-convex structures in Embodiment 5. The concave-convex structures set between each layer in this embodiment are shear keys 33, keyways 34, and keyholes 35, which can be embedded with each other correspondingly.

Specifically, in this embodiment, protruding shear keys 33 are provided at positions of the third joint part 23, the fourth joint part 24, the fifth joint part 25, and the sixth joint part 26 respectively. The shear key 33 of the third joint part 23 protrudes towards the surface corresponding to the first joint part 21, while the surface of the first joint part 21 corresponding to the third joint part 23 is provided with a keyway 34 that is embedded with the shear key 33 in a folded and overlapped state. The shear key 33 of the fourth joint part 24 protrudes towards the surface corresponding to the second joint part 22, while the surface of the second second joint part 22 corresponding to the fourth joint part 24 is provided with a keyway 34 that is embedded with the shear key 33 in a folded and overlapped state. The fifth joint part 25 and the sixth joint part 26 are both provided with shear keys 33 protruding towards the first thin sheet 1 and the second thin sheet 2, respectively. And key holes 35 are arranged on the first thin sheet 1 and the second thin sheet 2, which is configured to be embedded with the shear keys 33 respectively on the fifth joint part 25 and the sixth joint part 26 under a folded and overlapped state. The positions of shear keys 33, the keyways 34, and the keyholes 35 on the corresponding layers are evenly distributed along the longitudinal y-axis direction of the flexible layer support structure.

The keyway 34 is a blind hole structure, and the keyhole 35 is a through hole structure. The two structures can be designed according to the thickness of the set layer position.

The cross-sectional shape of the convex tooth structures or shear key structures in the embodiment can adopt trapezoidal, circular, rectangular, chamfered rectangular, triangular, irregular and other shapes, and the corresponding tooth slots, keyways or keyholes should be selected according to the corresponding cross-sectional requirements. The direction of the convex tooth and tooth slots should be parallel to each other, which can be a straight line along the same direction, as well as a curve or a broken line.

In practical applications, the concave-convex structures set between layers in the flexible layer support structure can also use concave-convex embossed structures distributed on the surface of the layers. By overlapping the concave-convex embossed structures distributed in different directions, the biting force and friction force between layers can be increased, thereby offsetting the interlayer shear force generated by the curling of the flexible layer support structure.

Embodiment 8

This embodiment provides an extended implementation solution for assembling a strip flexible layer support structure 9 into a panel flexible layer. This embodiment takes the strip flexible layer support structure 9 in Embodiment 1 as a basic unit, and several basic units are connected in parallel along the horizontal direction of the structure to form a wider panel flexible layer support structure 10.

Figure 21:
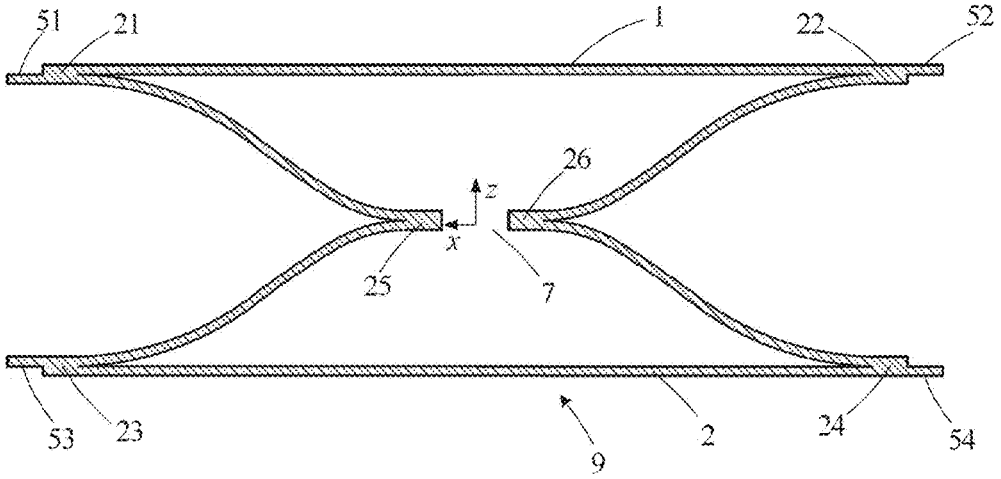
FIG. 21 is a cross-sectional view of the flexible layer support structure in Embodiment 8 under natural state.
Figure 22:
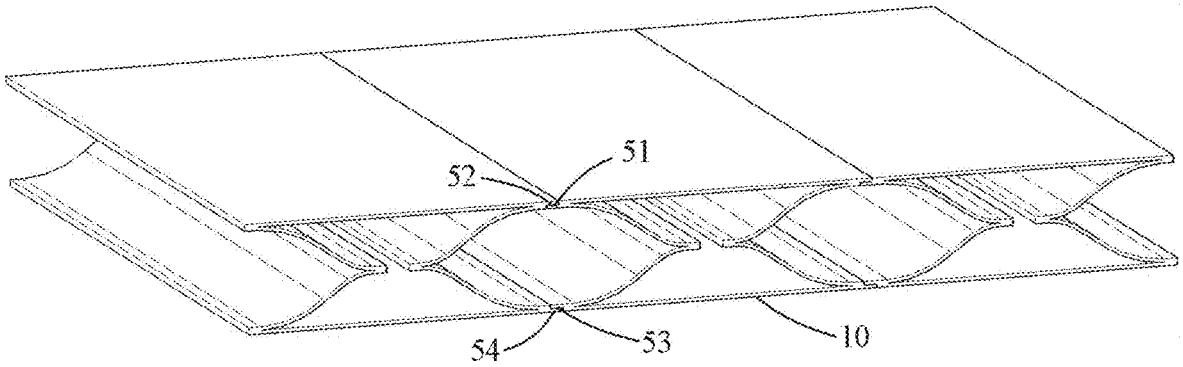
FIG. 22 shows the overall effect of horizontally splicing multiple flexible layer support structures in Embodiment 8.

Referring to FIG. 21, in this embodiment, based on the structure of Embodiment 1, at least two sets of thin sheets are assembled along the transverse x-axis direction, the curved elastic pieces at the positions of the first joint part 21 and the third joint part 23 on the lateral side of the strip flexible layer support structure 9 are respectively widened outward to overhang and form the first lap step 51 and the third lap step 53. On the other side, the the thin sheets at the positions of the second joint part 22 and the fourth joint part 24 are respectively widened outward to overhang and form the second lap step 52 and the fourth lap step 54. When two or more strip flexible layer support structures 9 are horizontally spliced, these lap steps are embedded with each other, increasing the overlapping area of the connection and increasing the firmness of the horizontal connection of the structure. By using the strip flexible layer support structure 9 in FIG. 21 as the the basic unit, lap steps of multiple strip flexible layer support structures 9 corresponding to each other are lapped and connected through adhesive bonding or welding, forming an overall structure as shown in the panel flexible layer support structure 10 in FIG. 22.

In the present invention, the terms "first," "second," and "third" are merely for the purpose of description, but cannot be understood as indicating or implying relative importance. The term "multiple" means two or more unless otherwise explicitly defined. The terms "mount," "connect with," "connect," "fix," and the like shall be understood in a broad sense. For example, "connect" may mean being fixedly connected, detachably connected, or integrally connected; and "connect with" may mean being directly connected or indirectly connected through an intermediary. For those of ordinary skill in the art, specific meanings of the above terms in the present invention can be understood according to specific situations.

In the description of the present invention, it should be understood that if orientation or position relations indicated by the terms such as "upper," "lower," "left," "right," "front," "back," and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

Certainly, the above descriptions are merely preferred embodiments of the present disclosure. The present disclosure is not limited to the above embodiments listed. It should be noted that, all equivalent replacements and obvious variations made by any person skilled in the art under the teaching of the specification fall within the essential scope of the specification and shall be protected by the present disclosure.

What is claimed is:

1. A flexible layer support structure, comprising at least two thin sheets overlapped with each other and at least two folding springs sandwiched between the thin sheets in parallel;

the folding springs are arranged parallel to each other along a first direction of the thin sheets, and each of the folding springs is a long waveform compression spring formed by even number of curved elastic pieces in series connection extending along a second direction of the thin sheets; the folding springs have an elastic trend of prop opening the thin sheets on two sides, and all of the curved elastic pieces are overlapped with the thin sheets to form a layer structure after being compressed;

outer edges of the curved elastic pieces at two outer ends of the folding springs are smoothly lapped with adjacent thin sheets, and a hollow thin-walled layer structure with bending stiffness is formed between the folding springs and the thin sheets; when the thin sheets are subjected to sufficient overlapping pressure in a deformation direction of the folding springs, all the thin sheets and the folding springs are overlapped into the layer structure that is capable to be bent or rolled up; and the folding springs quickly and elastically prop open the thin sheets to restore an original state after the overlapping pressure is removed;

wherein the thin sheets comprise a first thin sheet and a second thin sheet; all of the folding springs are distributed within a projection area where the first thin sheet and the second thin sheet overlapped with each other;

connection positions between the curved elastic pieces and the first thin sheet and the second thin sheet are fixed joint parts, connection positions between the curved elastic pieces within the projection area of the first thin sheet and the second thin sheet are free joint parts, and the free joint parts translate along the first direction of the thin sheets during folding and unfolding process of the folding springs, the free joint parts of adjacent folding springs are arranged in face-to-face direction or opposite direction, and a gap is set between the free joint parts arranged in the face-to-face direction for the free joint parts to translate;

surfaces of the curved elastic pieces of the folding springs, the first thin sheet, and the second thin sheet are provided with concave-convex structures that engage with each other under a folded and overlapped state of the flexible layer support structure.

2. The flexible layer support structure according to claim 1, wherein a sum of a width of all of the curved elastic pieces on a same layer after flattened unfolding and a gap width of joint parts is not greater than a width of the thin sheet connected to them.

3. The flexible layer support structure according to claim 1, wherein a cross section of the curved elastic pieces along the first direction is a smooth curve, and smooth transition to tangential connections form between ends at the two sides and the fixed joint part or the free joint part, forming folding springs with at least one V-shaped opening.

4. The flexible layer support structure according to claim 3, wherein curvature of the cross-section of the curved elastic pieces and any point after bending or winding of the thin sheets satisfies the following relationship:

$$\frac{1}{\rho} \leq \frac{2\sigma_e}{tE};$$

wherein: t is a thickness of the curved elastic pieces or the thin sheets;

E is an elastic modulus of the curved elastic pieces or the thin sheets;

$\rho$ is a curvature radius of a neutral layer of a single curved elastic piece or a single thin sheet;

$\sigma_e$ is an elastic limit value of the curved elastic pieces or the thin sheets.

5. The flexible layer support structure according to claim 1, wherein a fixed bonding method of the fixed joint parts and the free joint parts comprises bonding, welding, fusion, crimping or riveting.

6. The flexible layer support structure according to claim 1, wherein the thickness of the thin sheets and the curved elastic pieces is 0.001-2 mm.

7. A retractable device, comprising a winding shaft, a pressure roller, and a flexible layer installed on the winding shaft, wherein the flexible layer is used the flexible layer support structure according to claim 1;

there is a gap between the pressure roller and the winding shaft, or between the pressure rollers, with a width less than the thickness of the flexible layer in unfold state; the flexible layer passes through the gap and is wound and installed on the winding shaft; during a winding process of the flexible layer, through compression by the pressure roller and the winding shaft, and the folding springs and the thin sheets of the flexible layer support structure are overlapped into the layer structure and then wound on the winding shaft;

during a unwinding process of the flexible layer support structure, a part of the flexible layer support structure leaves the pressure roller and the winding shaft, and the folding springs unfold and prop open the thin sheets to restore a rigid and flat hollow thin-walled layer structure.

* * * * *